US006126473A

United States Patent [19]

Whorton

[11] Patent Number: 6,126,473

[45] Date of Patent: Oct. 3, 2000

[54] HIGH VOLTAGE ELECTRICAL SPLICE CONNECTOR

[76] Inventor: Jere D. Whorton, No. 408, 2101 Hayes Rd., Houston, Tex. 77077

[21] Appl. No.: 09/354,367

[22] Filed: Jul. 14, 1999

[51] Int. Cl.[7] ..... H01R 4/50

[52] U.S. Cl. ..... 439/332; 439/408; 439/790

[58] Field of Search ..... 439/332, 752, 439/708, 790, 333, 334, 335

[56] References Cited

U.S. PATENT DOCUMENTS

| | | | |
|---|---|---|---|
| H280 | 6/1987 | Thigpen | 429/7 |
| 1,137,295 | 4/1915 | Stearns | 439/332 |
| 1,179,970 | 4/1916 | Stearns | 439/335 |
| 1,559,684 | 11/1925 | Douglas | 439/332 |
| 2,880,403 | 3/1959 | Maxwell | 339/14 |
| 3,594,715 | 7/1971 | Dumesnil | 339/244 |
| 4,255,007 | 3/1981 | Michaels et al. | 339/88 R |
| 4,614,399 | 9/1986 | Gemra et al. | 339/205 |
| 4,895,530 | 1/1990 | Gugelmeyer | 439/311 |

*Primary Examiner*—Paula Bradley
*Assistant Examiner*—Alexander Gilman
*Attorney, Agent, or Firm*—John R Casperson

[57] ABSTRACT

An electrical connector for joining conductors is formed by a male plug half and a female receptacle half. Bus strips are positioned on the end of the plug and/or in the bottom of the female receptacle. Stripped wires are inserted into each end of the connector and pass through the bus strips and into the opposite half. Rotation of the male plug along a "quick connect" path bends the conductors tightly against the bus strips and clamps the wires between the bus strips.

20 Claims, 3 Drawing Sheets

HIGH VOLTAGE ELECTRICAL SPLICE CONNECTOR

BACKGROUND OF THE INVENTION

The present invention generally relates to an electrical connector. In one aspect, the invention relates to an electrical connector for connecting two electrical conductors together for use in high voltage, low current applications such as for neon signs.

Commercial neon signs, such as channel letter signs, require an approved connection for 6,000 to 15,000 volt, 20 to 120 milliamp circuits. To meet criteria of city and state electrical codes and the approval of testing laboratories, it has been necessary to either provide an uninterrupted continuity of conductors from one neon sign unit to the next, or provide an approved splice connector if this continuity is broken.

A connector well suited for this application which is inexpensive, simple in construction, easy to install, and which meets code requirements would be very desirable.

OBJECTS OF THE INVENTION

It is an object of the present invention to provide a high voltage electrical connector which can quickly and easily connect two electrical conductors together and provide the necessary criteria to meet electrical codes.

It is a further object of this invention to provide a means for making the connection, after the ends of the electrical conductors are stripped of insulation to leave a bare end, by hand, without tools, in a few seconds, by persons with no special skills.

It is a further object of this invention to provide a connector which is self-locking, although it can be disconnected and reused if desired or provided with a secondary lock.

Other and further objects, features and advantages will be apparent from the following description of a presently preferred embodiment of the invention, given for the purpose of disclosure and taken in conjunction with the accompanying drawings.

SUMMARY OF THE INVENTION

In one embodiment of the invention, there is provided a connector for splicing together electrical conductors. The connector comprises a plug and a plug receptacle for receiving the plug.

The plug is rotationally movable in the plug receptacle from a first rotational position to a second rotational position and longitudinally movable in the plug receptacle from a first longitudinal position to a second longitudinal position.

A camming means between the plug and the plug receptacle causes the plug to move from the first longitudinal position to the second longitudinal position as the plug is moved from the first rotational position to the second rotational position. When the plug is in the second longitudinal position, a bottom wall of the plug is positioned closely adjacent to a bottom wall of the plug receptacle. An electrically conductive bus means carried on the plug bottom wall of at least one of the plug and the plug receptacle is then positioned to join the conductors.

When the plug is positioned in the plug receptacle in the first rotational position there is defined a first electrical conductor passage and a second electrical conductor passage.

The first electrical conductor passage is defined by the plug receptacle, the bus, and the plug. The first electrical conductor passage has a first portion which extends longitudinally through the plug receptacle, a second portion which extends through the electrically conductive bus means, and a third portion which extends into the plug.

The second electrical conductor passage is defined by the plug, the bus, and the plug receptacle. The second electrical conductor passage has a first portion which extends longitudinally through the plug, a second portion which extends through the electrically conductive bus means, and a third portion extending into the plug receptacle.

The connector is properly configured for receiving electrical conductors in the first conductor passage and the second conductor passage when the plug is positioned in the plug receptacle in the first rotational position.

Once the electrical conductors are positioned in the conductor passages, rotation of the plug from the first rotational position to the second rotational position misaligns portions of the first conductor passage and the second conductor passage and clamps the electrical conductors positioned in the conductor passages tightly against the electrically conductive bus means.

The connector is thus properly configured for splicing electrical conductors together when the plug is positioned in the plug receptacle in the second rotational position.

In another aspect, the invention provides a method for splicing two electrical conductors together. To carry out the method, there is provided a connector as hereinabove described, a first electrical conductor having an insulated portion and a bare end portion, and a second electrical conductor having an insulated portion and a bare end portion. The plug is positioned in the plug receptacle in the first rotational position. The first electrical conductor is then positioned in the first electrical conductor passage with the bare end portion of the first electrical conductor positioned in the third portion of the first electrical conductor passage. The second electrical conductor is positioned in the second electrical conductor passage with the bare end portion of the second electrical conductor positioned in the third portion of the second electrical conductor passage. The plug is then rotated in the plug receptacle to the second rotational position to bend the bare end of the first electrical conductor and the bare end of the second electrical conductor across a face of the electrically conductive bus means and to bring the end wall of the plug to a position closely adjacent to the end wall of the plug receptacle. The bare end of the first electrical conductor and the bare end of the second electrical conductor are clamped firmly against the electrically conductive bus means.

DETAILED DESCRIPTION OF THE INVENTION

Figure 1:
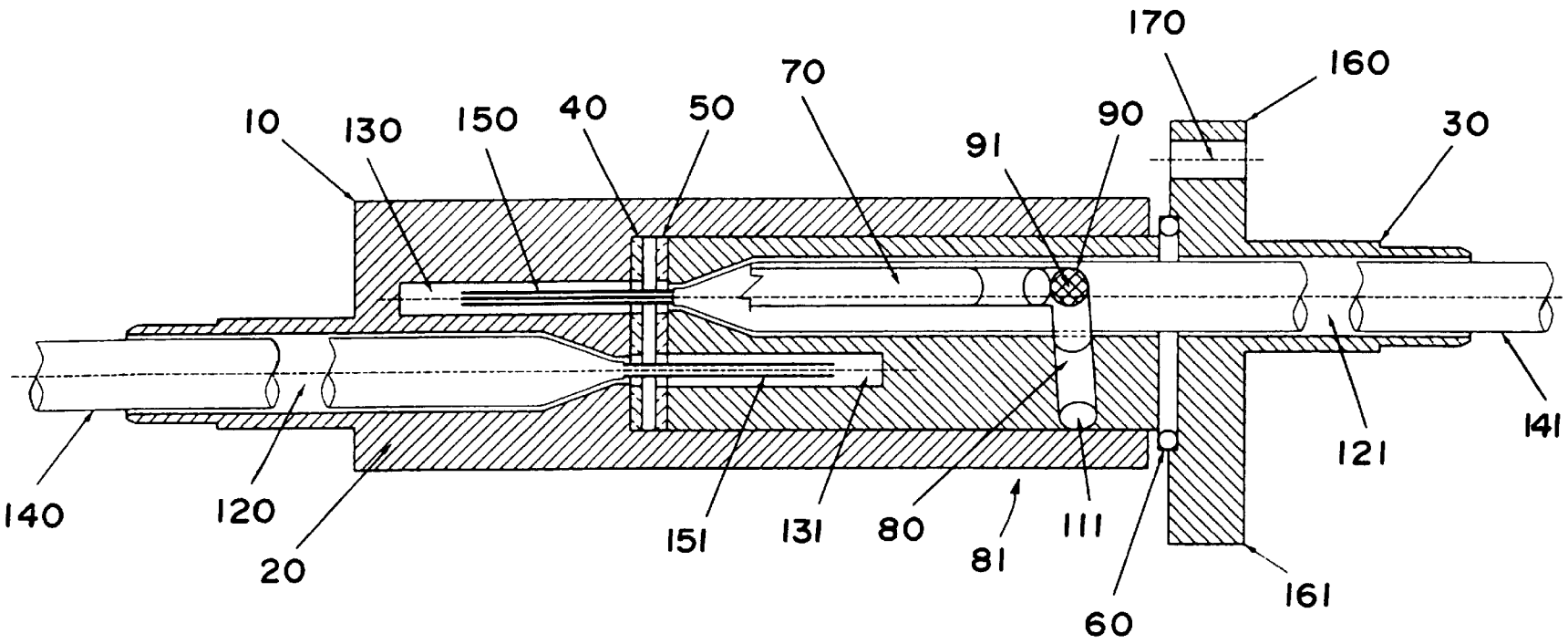
FIG. 1 is a longitudinal sectional view of the invention with the connector halves oriented with respect to each other to accept the insertion of electrical conductors.
Figure 2:
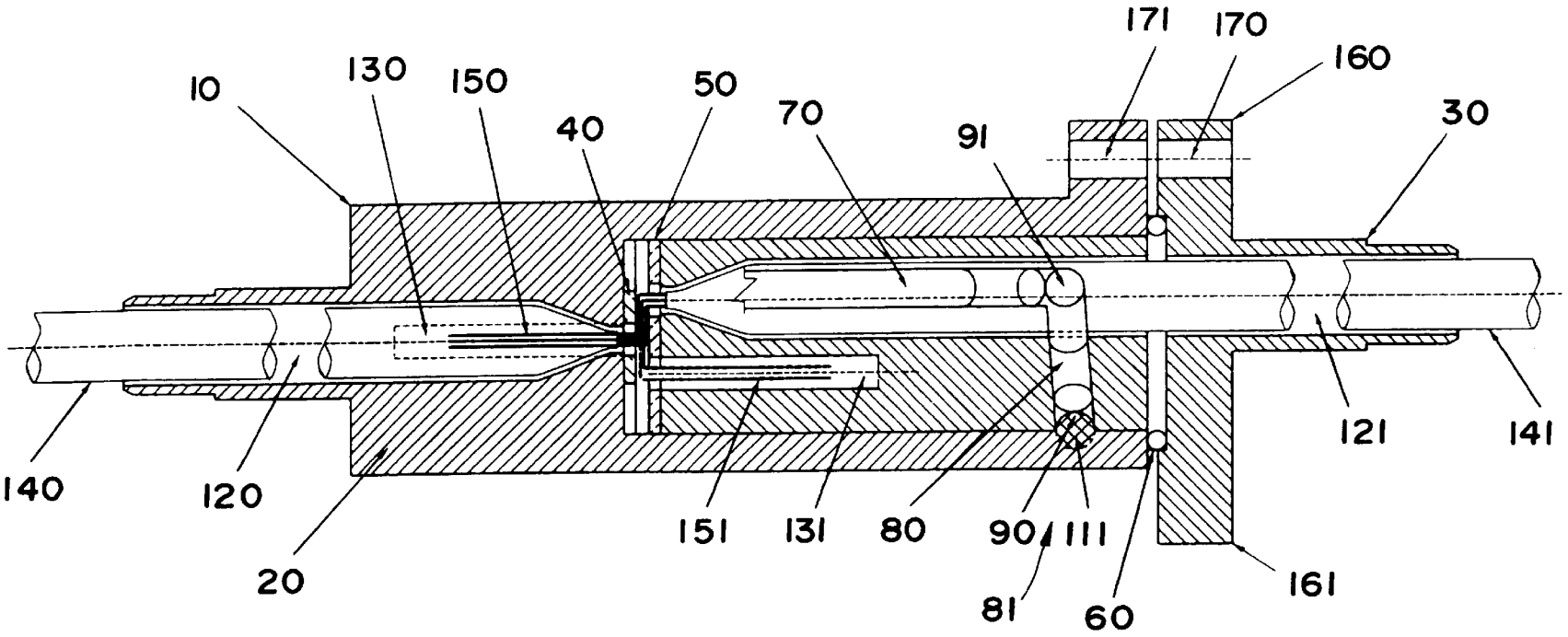
FIG. 2 is a longitudinal sectional view of the invention after the left hand connector half has been rotated about its longitudinal axis 90 degrees clockwise (as viewed from the left hand end) to lock in the electrical conductors.
Figure 3:
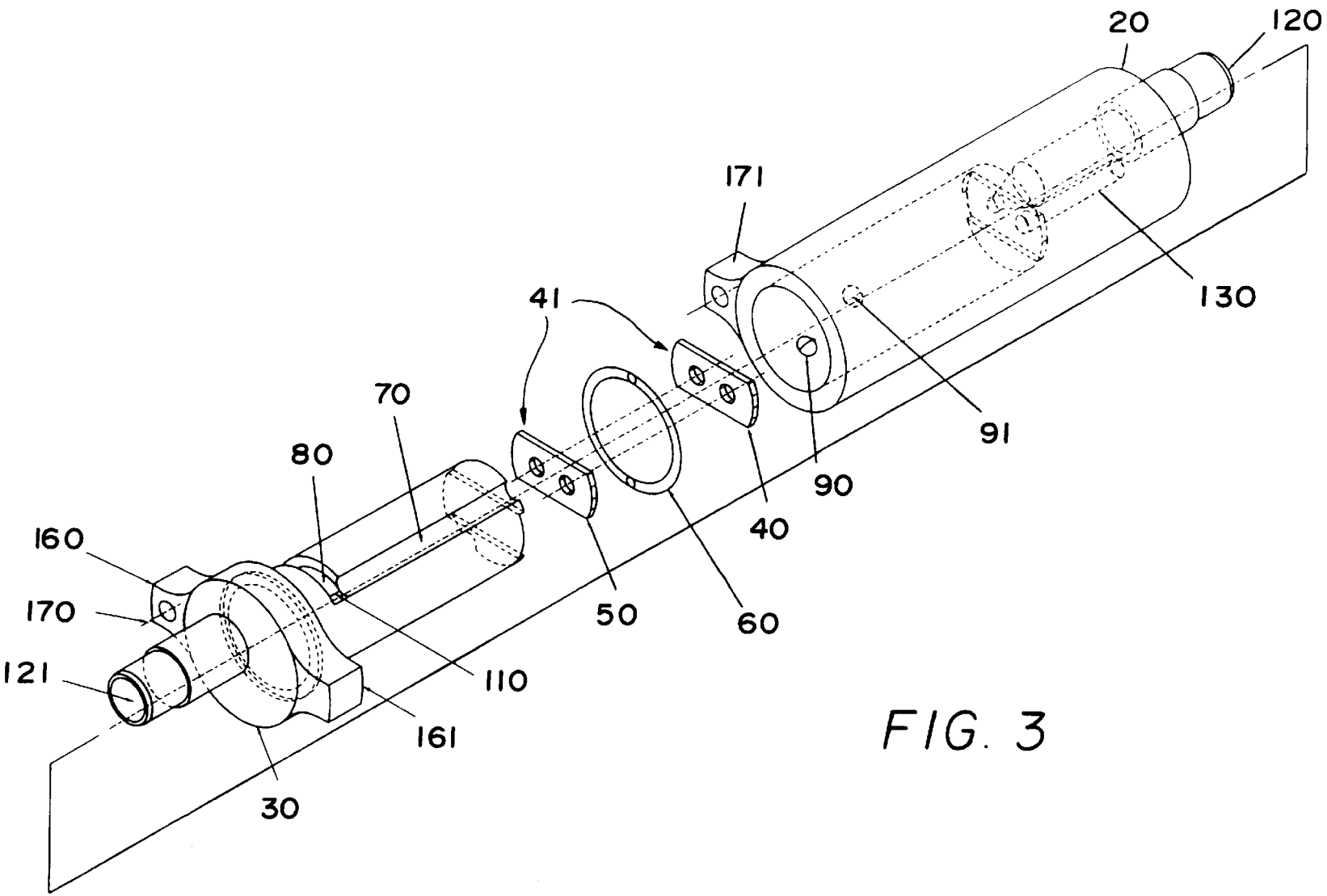
FIG. 3 is an exploded view of the connector shown in FIGS. 1 and 2.

In the Figures, the reference numeral 10 generally indicates the electrical connector of the present invention. The connector is well suited for high voltage, low current applications. As shown in FIGS. 1 and 2, the connector is for connecting two electrical conductors 150, 151 together. The conductors 150, 151 may be of any suitable type and size, for example, No. 18 AWG. The present connector 10 allows the connection between the conductors 150, 151 to be made manually and without any tools after the insulated conductors 140, 141 have been stripped back to provide bare ends 150, 151 respectively.

The connector 10 generally includes a plug receptacle and a plug. In the illustrated embodiment, the plug receptacle comprises a female enclosure 20 and the plug comprises a male enclosure 30. The male enclosure preferably has a generally cylindrical outside surface and the female enclosure preferably has a generally cylindrical inside surface sized to closely receive the male enclosure. The enclosures 20 and 30 may be of any suitable type of electrically insulating and flame retardant material. For example, a suitable material such as that sold under the trademark "LEXAN" is satisfactory. The enclosures 20 and 30 should preferably provide the necessary insulation to withstand the high voltages employed in the neon sign industry, such as 2,000 to 15,000 volt, 20 to 120 milliamp current.

At least one electrically conductive bus means 41 is carried on the plug bottom wall of at least one of the plug and the plug receptacle. In the illustrated embodiment, the electrically conductive bus means 41 comprises two metal contact plates 40 and 50, one carried on each bottom wall, although it is to be understood that either plate can be employed alone if desired. The two metal contact plates 40 and 50 are constructed of a suitably conducting material, such as copper or brass, and have an adequate thickness to withstand the high voltages and low current typically employed in use of this connection.

In a preferred embodiment of the invention, an 'O' ring seal 60 is positioned between the plug and the plug receptacle so as to compress and form a moisture resistant seal upon movement of the plug into the second longitudinal position. See FIG. 2. For neon sign application, the 'O' ring 60 should be of a suitable material, such as 'NITRILE' to withstand the high voltages and should also be of fire retardant material.

To use the invention, with reference to FIG. 1, the two insulated conductors 140, 141 with their bare ends 150, 151 are inserted into the entry holes which are located on each end of the connector 10 for first electrical conductor passage 120 and the second electrical conductor passage 121. As the two bare conductors 150, 151 reach the end of the first portion of their respective passages (that portion of the passage in the connector half having the entry hole), they pass, in the illustrated embodiment, through passage portions in the two metal contact plates 40, 50 attached to the ends of the adjoining mating surfaces of the female part 20 and the male part 30 respectively and then continue into the third portion of the respective passages (that portion of the passage in the connector half opposite from the entry hole) which constitutes the bare wire receptacle 130 located in the female part 20 and the bare wire receptacle 131 located in the male part 30. All portions of the electrical conductor passages are longitudinally in an aligned position with the longitudinal entry hole 120 in the female part 20 and the male part 30 when the plug and plug receptor are in the first rotational position.

When each of the two conductors are inserted into the opposite ends of the connector, the bare wires of the conductors entering the male or female part continue through the two flat metal contact plates placed perpendicular to the longitudinal enclosure so as to provide a continuation of the hole alignment of the longitudinal openings in both male and female parts of the enclosure. The bare wires of the conductors enter each end of the enclosure then terminate in the aligned continuation of the entry hole in the opposite part of the enclosure. For instance, the bare part of the stripped conductor and a portion of the insulated conductor is inserted into the opening on the end of the male part, whereby the bare stripped conductor travels through the aligned holes in the two metal contact plates and then continues into the aligned bare-wire receptacle in the female part. The two bare ends of both conductors, having passed through the two metal contact plates placed perpendicular to their longitudinal travel path from opposite directions, are now positioned to develop two 90° bends as the rotation of the male part of the enclosure causes portions of the passages to mis-align, thereby causing the stripped electrical conductors to first bend 90° from the longitudinal and lay flat between the two metal contact plates, and then additionally bend longitudinally 90° ending in the adjoining bare wire receptacle.

The male part 30 can be gripped by the operator using the two finger grips 160, 161 and rotated to the second rotational position, thereby achieving the connected and closed position. See FIG. 2. It is to be understood that the same result can be achieved by rotating the female part—that it is relative rotation between the parts that achieves the desired result. Generally speaking, most any amount of rotation will be adequate to jam the wires. However, rotation in an amount of at least 30° is believed generally preferred. In the illustrated embodiment, the plug is rotated clockwise 90° relative to the plug receptor. At this time a positive locking position may be maintained by placing a key or pin into the locking holes 170, 171 that are now in an aligned position between the finger grips 160 and the adjoining projection of the female part 20.

A camming means 81 between the plug and the plug receptacle preferably causes the plug to move from the first longitudinal position to the second longitudinal position as the plug is moved from the first rotational position to the second rotational position. In the Figures, the camming means 81 comprises a pin 90 and a diagonal keyway 80. The pin can protrude from one of the generally cylindrical inside surface and the generally cylindrical outside surface of the plug or receptacle and the keyway to receive the pin can be formed in the other. In a preferred embodiment, the male and female parts of the enclosure are provided with two longitudinally slotted key-ways 70, 71 on the outer mating surface of the male part which accepts two matching guide pins 90, 91 which are located on the inner mating surface of the female part. The two slotted key-ways and the matching pins are opposed, but preferably slightly less than 180° so as to prevent a 180° mis-alignment of the longitudinal openings of the male and female parts during assembly. Misalignment protection can also be provided by utilizing differently sized pins, or by only using a single pin and key way. At the end of the generally longitudinal travel of the two key-ways of the male part, the direction of the two key-ways turns diagonally, to follow a screw path. For example, the key-ways can turn to form an angle of 86° from the longitudinal, thus providing a camming action as the matching pins on the mating surface of the female part follow the slotted key-ways on the surface of the male part. This camming action serves to bring the end of the male part to within the desired distance of the adjoining surface of the female part.

Preferably, the plug is in the first rotational position when the male part has become fully engaged longitudinally within the female part, but before the male part is rotated clockwise 90°. In this position, the separation between the end of the male part and the adjoining surface of the female part preferably approximates the thickness of the bare conductor, and as the rotation of the male part occurs, the separation between the two metal contact plates attached to the end of the male part and the adjoining surface of the female part is reduced by approximately 50% due to the longitudinal travel of the male part relative to the female part caused by the guide pins on the inner mating surface of the female part following the 86° diagonal departure from the longitudinal of the slotted key-ways on the outer mating surface of the male part.

Therefore the 90° clockwise rotation of the male part not only creates two 90° bends in the stripped electrical conductors, but as the two conductors are bent and lay between the two metal contact plates, the two conductors are simultaneously compressed between the two metal contact plates to approximately 50% of their original thickness which provides electrical connection between the two conductors, and combined with the configuration of the two conductors in the rotated or locked position created by the bending of the two conductors a very substantial strain relief of the two conductors is accomplished.

Still further, the clockwise rotation in a preferred embodiment provides a method of sealing by the positioning of an 'O' ring 60 around the mating surface of the male part. The same longitudinal movement of the male part relative to the female part which causes the compression of the two conductors between adjoining surfaces of the male and female parts also creates a compression of the 'O' ring between the bodies of the male and female parts, thereby creating a moisture resistant seal at this point. See FIG. 2.

After the two conductors 150, 151 are positioned in their respective positions within the female part 20 and the male part 30, the rotation of the male part 30 within the female part 20 creates the following series of actions in the preferred embodiment of the invention:

1. The bare wires 150, 151 are bent diagonally 90° and lay between the two adjoining surfaces of the metal contact plates 40 and 50.
2. The bare wires 150, 151 are simultaneously bent longitudinally 90°.
3. The male part 30 travels longitudinally toward the end of the female part 20 thereby compressing the bare wires 150, 151 between the two metal contact plates 40 and 50 attached to the ends of the female part 20 and the adjoining male part 30, thereby creating the electrical connection of the two conductors 150, 151.
4. The 'O' ring 60 surrounding the surface of the male part 30 is sufficiently compressed between the male part 30 and the female part 20 thereby creating a moisture resistant seal at that point.
5. The two bending actions of the bare conductors 150, 151 because of the mis-alignment of the longitudinal openings through which they pass creates a longitudinal tensioning of the insulated conductors 140, 141 causing them to be forced into the tapered portion of the entry holes 120, 121 through which they pass, thereby creating a moisture resistant seal at that point.
6. The combined bending of the conductors 150, 151 and the compression of the conductors 150, 151 between the two metal contact plates 40 and 50 create a substantial strain relief for the connection.
7. Also, in a preferred embodiment, as the two guide pins 90, 91 travel along the two diagonal key-ways during rotation of the male part 30 they fall into the detents 110 at the ends of the diagonal key ways 80 and provide a releasable locking position for the connector 10.

Preferably, detents provide releasable locking in two positions. When the two pins on the female mating surface are engaged with the longitudinal portion of the two key-ways, the longitudinal openings receiving the conductors are in perfect alignment, and when the male part is fully inserted into the female part, each pin drops into a detent 10 located at the end of the longitudinal key-ways, thus maintaining this relative position of the two parts until the operator inserts the insulated conductor with a bare end into the opening in the end of both parts. The insulated portion of the conductors is inserted until the tapering portion of the passage is reached, whereupon the stripped or bare portion of each conductor continues through the two metal contact plates placed perpendicular to the conductor and attached, one to the end of the male mating portion and the other to the adjoining female part.

When the male part is then rotated clockwise 90° within the female part, the detent pressure at the end of the longitudinal travel of the two key-ways is overcome, and the two pins located on the inner mating surface of the female part engage with the two diagonal key-ways located on the outer mating surface of the male part and travel diagonally 86° until they reach the end of the diagonally directed key-ways and drop into detents 111 positioned at the end of the diagonal travel of the two key-ways, thus locking the male and female parts into this closed and final position.

The present invention, therefore, is well adapted to carry out the objectives and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A connector for splicing together electrical conductors, said connector comprising a plug, a plug receptacle for receiving the plug, said plug being rotationally movable in the plug receptacle from a first rotational position to a second rotational position and longitudinally movable in the plug receptacle from a first longitudinal position to a second longitudinal position, wherein a bottom wall of the plug is positioned closely adjacent to a bottom wall of the plug receptacle when the plug is in the second longitudinal position, a camming means between the plug and the plug receptacle for moving the plug from the first longitudinal position to the second longitudinal position as the plug is moved from the first rotational position to the second rotational position; and an electrically conductive bus means carried on the plug bottom wall of at least one of the plug and the plug receptacle, said connector defining, when the plug is positioned in the plug receptacle in the first rotational position a first electrical conductor passage having a first portion extending longitudinally through the plug receptacle, a second portion extending through the electrically conductive bus means, and a third portion extending into the plug, and a second electrical conductor passage having a first portion extending longitudinally through the plug, a second portion extending through the electrically conductive bus means, and a third portion extending into the plug receptacle, whereby said connector is configured for receiving electrical conductors in the first conductor passage and the second conductor passage when the plug is positioned in the plug receptacle in the first rotational position, and wherein rotation of the plug from the first rotational position to the second rotational position misaligns portions of the first conductor passage and the second conductor passage and clamps electrical conductors positioned in the conductor passages tightly against the electrically conductive bus means, whereby the connector is configured for splicing electrical conductors together when the plug is positioned in the plug receptacle in the second rotational position.

2. A connector as in claim 1 wherein the electrically conductive bus means comprises a first metallic electrical contact plate positioned on the bottom wall of the plug and a second metallic electrical contact plate positioned on the bottom wall of the plug receptacle.

3. A connector as in claim 1 further comprising an 'O' ring seal positioned between the plug and the plug receptacle so as to compress and form a moisture resistant seal upon movement of the plug into the second longitudinal position.

4. A connector as in claim 1 wherein the first portion of the first electrical conductor passage has a tapering portion which tapers toward the bottom wall of the plug receptacle and the first portion of the second electrical conductor passage has a tapering portion which tapers toward the bottom wall of the plug.

5. A connector as in claim 4 further comprising a first electrical conductor having an insulated portion and a bare end portion positioned in the first electrical conductor passage with the insulated portion compressed against the tapering portion of the first electrical conductor passage to form a moisture resistant seal; and a second electrical conductor having an insulated portion and a bare end portion positioned in the second electrical conductor passage with the insulated portion compressed against the tapering portion of the first electrical conductor passage to form a moisture resistant seal.

6. A connector as in claim 1 wherein the electrically conductive bus means comprises a metallic electrical contact plate positioned perpendicular to the first conductor passage and the second conductor passage.

7. A connector as in claim 6 wherein the metallic electrical contact plate is positioned on the bottom wall of the plug.

8. A connector as in claim 2 further comprising, in combination a first electrical conductor having an insulated portion and a bare end portion, said bare end portion having a 90° bend and contacting the metallic electrical contact plate, and a second electrical conductor having an insulated portion and a bare end portion, said bare end portion having a 90° bend and contacting the metallic electrical contact plate, wherein continuity is established between the first electrical conductor and the second electrical conductor by the metallic electrical contact plate.

9. A connector as in claim 8, further comprising, in combination, a channel letter neon sign containing at least one neon tube unit having a first end and a second end, wherein the first electrical conductor is electrically connected to the first end of the neon tube unit.

10. A connector as in claim 1 wherein the plug has a generally cylindrical outside surface, the plug receptacle has a generally cylindrical inside surface which closely receives the outside surface of the plug, the camming means between the plug and the plug receptacle comprises a first pin protruding from one of the generally cylindrical inside surface and the generally cylindrical outside surface and a first keyway to receive the first pin formed in the other of the generally cylindrical inside surface and the generally cylindrical outside surface, said first keyway having a first portion which follows a screw path from a first longitudinal position to a second longitudinal position over a rotational angle of at least about 30 degrees.

11. A connector as in claim 10 wherein the first pin protrudes from the plug and the first keyway is formed in the plug receptacle.

12. A connector as in claim 11 further comprising a second pin formed on the plug and a second keyway formed in the plug receptacle, said second pin and said second keyway being spaced from the first pin and first keyway by an angle of near 180 degrees so that the plug can only be inserted into the plug receptacle in a single orientation.

13. A connector as in claim 11 wherein the first keyway further has a second portion which extends generally longitudinally from an outer end of the plug receptacle to the first longitudinal position.

14. A connector as in claim 13 wherein the first keyway has a first detent means for restraining the first pin in the first longitudinal position.

15. A connector as in claim 14 wherein the first keyway has a second detent means for restraining the first pin in the second longitudinal position.

16. A method for splicing two electrical conductors, said method comprising providing a connector for splicing together electrical conductors, said connector comprising a plug, a plug receptacle for receiving the plug, said plug being rotationally movable in the plug receptacle from a first rotational position to a second rotational position and longitudinally movable in the plug receptacle from a first longitudinal position to a second longitudinal position, wherein a bottom wall of the plug is positioned closely adjacent to a bottom wall of the plug receptacle when the plug is in the second longitudinal position, a camming means between the plug and the plug receptacle for moving the plug from the first longitudinal position to the second longitudinal position as the plug is moved from the first rotational position to the second rotational position; and an electrically conductive bus means carried on the plug bottom wall of at least one of the plug and the plug receptacle, said connector defining, when the plug is positioned in the plug receptacle in the first rotational position a first electrical conductor passage having a first portion extending longitudinally through the plug receptacle, a second portion extending through the electrically conductive bus means, and a third portion extending into the plug, and a second electrical conductor passage having a first portion extending longitudinally through the plug, a second portion extending through the electrically conductive bus means, and a third portion extending into the plug receptacle, whereby said connector is configured for receiving electrical conductors in the first conductor passage and the second conductor passage when the plug is positioned in the plug receptacle in the first rotational position, and wherein rotation of the plug from the first rotational position to the second rotational position misaligns portions of the first conductor passage and the second conductor passage and clamps electrical conductors positioned in the conductor passages tightly against the electrically conductive bus means, whereby the connector is configured for splicing electrical conductors together when the plug is positioned in the plug receptacle in the second rotational position;

providing a first electrical conductor having an insulated portion and a bare end portion;

providing a second electrical conductor having an insulated portion and a bare end portion;

positioning the plug in the plug receptacle in the first rotational position positioning the first electrical conductor in the first electrical conductor passage with the bare end portion of the first electrical conductor positioned in the third portion of the first electrical conductor passage;

positioning the second electrical conductor in the second electrical conductor passage with the bare end portion of the second electrical conductor positioned in the third portion of the second electrical conductor passage; and rotating the plug in the plug receptacle to the second rotational position to bend the bare end of the first electrical conductor and the bare end of the second electrical conductor across a face of the electrically conductive bus means and to bring the end wall of the plug to a position closely adjacent to the end wall of the plug receptacle and clamp the bare end of the first electrical conductor and the bare end of the second electrical conductor firmly against the electrically conductive bus means.

17. A method as in claim 16 wherein when the plug is in the first position in the plug receptacle, the first electrical conductor is positioned in the first electrical conductor passage so that the insulated portion of the first electrical conductor contacts a tapering portion of the first electrical conductor passage and the second electrical conductor is positioned in the second electrical conductor passage so that the insulated portion of the second electrical conductor contacts a tapering portion of the second electrical conductor passage.

18. A method as in claim 17 wherein an 'O' ring seal is positioned between the plug and the plug receptacle so as to compress and form a moisture resistant seal upon movement of the plug into the second longitudinal position;

said method further comprising:

rotating the plug in the plug receptacle to the second position whereby the insulated portion of the first electrical conductor is pulled against the tapering portion of the first electrical conductor passage to form a water resistant seal in the first electrical conductor passage, the insulated portion of the second electrical conductor is pulled against the tapering portion of the second electrical conductor passage to for a water resistant seal in the second electrical conductor passage, and the 'O' ring seal is compressed to form a moisture resistant seal between the plug and the plug receptacle.

19. A method as in claim 16 wherein the plug has a generally cylindrical outside surface, the plug receptacle has a generally cylindrical inside surface which closely receives the outside surface of the plug, the camming means between the plug and the plug receptacle comprises a first pin protruding from one of the generally cylindrical inside surface and the generally cylindrical outside surface and a first keyway to receive the first pin formed in the other of the generally cylindrical inside surface and the generally cylindrical outside surface, said first keyway having a first portion which follows a screw path from a first longitudinal position to a second longitudinal position over a rotational angle of at least about 30 degrees, and a second portion which extends generally longitudinally from an outer end of the plug receptacle to the first longitudinal position, wherein the keyway has first detent means to restrain the pin in the first longitudinal position and a second detent means to restrain the pin in the second longitudinal position wherein said method further comprises sliding the plug into the plug receptacle with the pin sliding along the first portion of the keyway until the pin engages the first detent means and the plug is positioned in the first rotational position;

then positioning the first electrical conductor in the first electrical conductor passage with the bare end portion of the first electrical conductor positioned in the third portion of the first electrical conductor passage, and the second electrical conductor in the second electrical conductor passage with the bare end portion of the second electrical conductor positioned in the third portion of the second electrical conductor passage; then rotating the plug in the plug receptacle with the pin sliding along the second portion of the keyway until the pin engages the second detent means and the plug is positioned in the second rotational position.

20. A high voltage electrical splice connector for connecting two electrical conductors together comprising:

a. a female and male tubular part containing two metallic electrical contact plates placed perpendicular to the aligned longitudinal openings at their innermost mating location through which the conductors pass, one from each end, and which creates the connection when the male part is rotated within the female part 90°;

b. an 'O' ring that compresses and creates a moisture resistant seal upon rotation of the male part within the female part, c. tensioning of the conductors during closure that compresses the insulated portion of the conductors against the tapered walls of the entry holes and provides moisture resistance at that point, d. a dual 90° bending and compression of each conductor during the rotation of the male part within the female pat, providing both sufficient compression of the conductors between the metal contact plates and simultaneously providing adequate strain relief of the conductors, e. an initial locking position upon full insertion of the male part into the female part, to provide an initial locked open position, f. a final locked position in the closed and final position after rotation of the male part within the female part 90°, g. two finger grips on the male part to facilitate closure by hand without tools, and h. a matching projection on the body of the female part which, in the closed position, aligns with one finger grip on the male part to provide matching and aligned holes in both the projection on the female and male part for the insertion of a pin, key, or other rigid device providing a positive and permanent locking method.

* * * * *